United States Patent [19]

Rutledge

[11] 4,363,864

[45] Dec. 14, 1982

[54] COLLOID RELIEF IMAGES BY OXIDIZED DEVELOPER TRANSFER

[75] Inventor: Robert L. Rutledge, St. Paul, Minn.

[73] Assignee: Minnesota Mining and Manufacturing Company, Saint Paul, Minn.

[21] Appl. No.: 904,546

[22] Filed: May 10, 1978

[51] Int. Cl.[3] ..... G03C 5/54; G03C 1/48

[52] U.S. Cl. ..... 430/202; 430/539; 530/642

[58] Field of Search ..... 96/67, 76 R, 29 R, 114.8, 96/84 R; 430/202, 523, 531, 533, 536, 537, 539, 628, 642

[56] References Cited

U.S. PATENT DOCUMENTS

| | | | |
|---|---|---|---|
| 2,525,753 | 10/1950 | Yutzy et al. | 96/114.8 |
| 2,592,263 | 4/1952 | Frame | 96/114.8 |
| 2,763,639 | 9/1956 | Elins et al. | 96/114.8 |
| 3,118,766 | 1/1964 | Roth | 96/114.8 |
| 3,364,024 | 1/1968 | Yackel et al. | 96/76 R |
| 3,575,703 | 4/1971 | Judd et al. | 96/76 R |
| 3,782,955 | 1/1974 | Mucke et al. | 96/114.8 |
| 4,022,620 | 5/1977 | Okumura et al. | 96/100 |

*Primary Examiner*—Richard L. Schilling

*Attorney, Agent, or Firm*—Cruzan Alexander; Donald M. Sell; Gerald F. Chernivec

[57] ABSTRACT

An article comprising a substrate having coated on one surface thereof a first layer comprising a colloidal material capable of being tanned when contacted with oxidized silver halide developers, and overyling said first layer a second layer comprising a photographic silver halide emulsion, said emulsion containing substituted gelatin therein, said substituted gelatin being substantially resistant to tanning when contacted by said oxidized silver halide developers.

7 Claims, No Drawings

COLLOID RELIEF IMAGES BY OXIDIZED DEVELOPER TRANSFER

BACKGROUND OF THE INVENTION

This invention is related to a photographic process for the preparation of colloid relief images, and more particularly with the utilization of colloid insolubilizing developing agents in conjunction with a non-hardening silver halide emulsion.

It is of course well known in the art to utilize developing agents to insolubilize colloidal materials, e.g., gelatin, in a silver halide emulsion. Typically, in the employment of this hardening reaction, a tanning developer such as catechol is utilized to develop an exposed silver halide colloidal emulsion, after which the unexposed areas may be washed away utilizing warm water, to thereby obtain a photographic image or resist of the hardened or tanned colloid.

This mechanism for obtaining a photographic resist, however, has typically not been available when the colloidal materials are removed from the site at which development occurs, such as for example in a colloidal layer adjacent the silver halide layer. For example, it is disclosed in U.S. Pat. No. 3,364,024 that catechol only insolubilizes gelatin at very short distances from the location at which the oxidation of the catechol occurs.

In aforementioned U.S. Pat. No. 3,364,024, there is disclosed a process for obtaining a photographic resist in a gelatin or colloid layer which is separate from and adjacent to the silver halide emulsion layer. In essence, the patentees therein found that certain oxidized developing agents are capable of "wandering" from the location at which oxidation of the developer occurs, i.e., in the silver halide emulsion layer, to a separate gelatin or colloid layer, thereby rendering same insolubilized in an imagewise manner.

In this process, however, the silver image is retained in the image pattern because a tannable or hardenable gelatin is utilized in the silver halide emulsion of the construction. To eliminate the silver from the structure, conventional bleaching and fixing steps are of course necessary. Such processing steps require additional time, require necessary additional solutions, and in addition, the silver must be recovered in two solutions, i.e., both the wash and fix solution, and is thereby difficult to be recovered therefrom.

SUMMARY OF THE INVENTION

In accordance with the invention there is provided an article comprising a substrate having coated on one surface thereof a first layer comprising a colloid material capable of being rendered water-insoluble, i.e., tanned, in the presence of oxidized silver halide developers, and coated over said first layer a second layer comprising a photographic silver halide emulsion, said emulsion containing a substituted gelatin therein, said gelatin being substantially resistant to tanning when contacted by said oxidized silver halide developers.

After development of the silver image on the substrate, a washing of the substrate surface with warm water results in the complete removal of the silver halide emulsion overlayer and removal of the unhardened or untanned colloid material in the underlayer in an imagewise fashion. This avoids the necessity of having to remove the metallic silver image areas by bleaching and fixing processes, and allows for easy reclaiming of the silver from a single solution.

DETAILED DESCRIPTION OF THE INVENTION

As aforementioned, the use of silver halide developer oxidation products to harden gelatins in a layer removed from the photographic emulsion layer is disclosed in U.S. Pat. No. 3,364,024.

As disclosed therein, only certain tanning developers can be utilized, examples of which are 1,4-dihydroxy benzene compounds such as hydroquinone, chlorohydroquinone, bromohydroquinone, toluhydroquinone, morpholine methyl hydroquinone, etc. In addition, certain additives, for example monoethanolamine, can be utilized in conjunction with such tanning developers to increase image resolution or enhance other properties, such as are disclosed in U.S. Pat. No. 3,293,035.

My construction consists of two layers on a support. The layer adjacent the support is comprised of a conventional unhardened colloid material, such as gelatin (which is, however, capable of being hardened or tanned by the aforementioned oxidation process). Additives such as dyes, developers, pigments, etc. can be added in concentrations of about 1 percent to as much as 50 percent or more depending on the application intended. While gelatin is the preferred colloid for this layer, other colloidal resins may be utilized which are capable of being imagewise hardened or tanned with tanning silver halide oxidized developers, such as other proteins, e.g., casein, zein, etc.

During development of conventional silver halide emulsions, tanning, or the physical property of increasing the insolubility of gelatin or similar colloids in hot water, occurs. Tanning, or the reaction which produces the insolubilization, occurs through the amine groups normally occurring in a gelatin. To avoid tanning of the gelatin, it is therefore necessary to substitute groups on the gelatin amine groups, which thereby effectively blocks the reaction producing tanning and allows the substituted gelatin to remain water soluble.

Examples of substituted gelatins capable of functioning in my invention include the derivatives disclosed in U.S. Pat. No. 2,525,753, which are formed by reacting gelatin with various organic anhydrides, such as phthalic, maleic and succinic anhydrides. Further examples are the derivatives disclosed in U.S. Pat. Nos. 2,592,263 (reaction products of isocyanates with gelatin); 3,282,698 (reaction products of bromoacetic acid with gelatin); and 3,575,703 (cyanoethylated gelatins).

The silver halide emulsion utilized herein, in conjunction with a substituted gelatin, include the conventional silver chloride, silver bromide, silver chloroiodide, silver chlorobromide, silver chlorobromoiodide, silver bromoiodide, etc. In addition, direct positive emulsions may be utilized to provide direct positive images in the colloid underlayer, such as are disclosed in U.S. Pat. No. 3,062,651 and U.K. Pat. No. 723,019. In such emulsions, non-hardening fogging agents such as stannous chloride are typically utilized.

Coating thicknesses of the non-light-sensitive colloid underlayer are not critical, but in general the thinner the coating, the better resolution or image detail of the resultant colloid relief image. In general, thicknesses of from about 0.8 to about 2.0 micrometers are satisfactory.

The silver halide emulsion overlayer coating weight, in terms of the silver deposition, can be varied over rather broad limits. Generally, at least about 10 milligrams per square decimeter of silver is necessary, and over 60 milligrams per square decimeter can be utilized without negatively affecting operability. About 25 milligrams per square decimeter is preferred, as increasing concentrations provide no benefit and are wasteful of the silver.

The tanning developing agent may be incorporated in the silver halide emulsion or the non-silver halide containing layer and development attained by using an alkaline activator, or development may be carried out by immersing the exposed photographic emulsion in a conventional alkaline developing bath provided the oxidized developing agent is one of those identified above as a "wandering" insolubilizing developing agent.

Typical activator baths for the photographic emulsion containing the developing agent comprise, for example, an aqueous solution of an alkaline material, such as sodium carbonate, sodium hydroxide, potassium carbonate, potassium hydroxide, mixtures of sodium hydroxide and sodium sulfate, etc. Suitable baths can comprise, for example, an aqueous solution containing about 1 percent sodium hydroxide and 5 percent sodium sulfate.

It will be appreciated that any of the known hydroquinone compounds which have alkali splittable groups thereon to stabilize the hydroquinone during storage may be incorporated in the emulsion. These compounds release hydroquinone in the presence of alkali and may be used in whole or in part to replace the hydroquinone or hydroquinone derivative incorporated in the silver halide emulsion, in the non-silver halide containing layer or in the processing solution.

An auxiliary developing agent can be used along with a hydroquinone developing agent in order to improve the speed without affecting the operation of my invention. Typical auxiliary developing agents include 3-pyrazolidone developing agents known in the art as well as Elon (N-methyl-p-aminophenol sulfate) and the like. Useful auxiliary agents are 1-phenyl-3-pyrazolidone and 1-phenyl-4,4-dimethyl-3-pyrazolidone.

Photographic silver halide emulsions in my invention can also contain such additives as chemical sensitizers, speed-increasing compounds, reducing agents, sensitizing dyes, etc., which are known to those skilled in the art. They may be blue sensitive, orthochromatic, panchromatic, infrared sensitive, etc., emulsions.

Suitable supports comprise any of the well known supports such as cellulose ester film base (e.g., cellulose acetate butyrate, cellulose nitrate, cellulose acetate, cellulose acetate propionate, etc.), polyethylene, polypropylene, polystyrene, polyethylene terephthalate and other polyesters, paper, polyethylene coated glassine paper, glass, metal, polycarbonates, etc.

In use, my construction is exposed to light in a normal fashion, developed with a tanning developer, as previously defined, and washed in hot water. The entire top layer containing the substituted gelatin and the silver therein is removed, and those areas of the bottom layer adjacent the support which were not contiguous with the developed silver in the top layer are removed. This results in a colloid relief image, wherein the residual colloid corresponds with the original light exposure.

The invention will now be more specifically described by the aid of the following non-limiting examples, wherein all parts are by weight unless otherwise specified.

EXAMPLE 1

Four parts of a conventional photographic grade gelatin, PLEX 1443, commercially available from P. Liener and Sons were soaked for 30 minutes in 100 parts of water and heated to 40° C. to dissolve. The solution was then coated onto 75 micrometer polyester and dried to provide a dry coating weight of 0.8 gram per square centimeter.

A photographic emulsion was then prepared by first soaking 25 parts of PLEX 3292, tradename for a 100 percent phthalated galatin commercially available from P. Liener and Sons in 500 parts of water for 30 minutes followed by heating to 50° C. to dissolve. Then, 59 parts of solid sodium chloride were added and stirring maintained until dissolved.

A second solution was then prepared by mixing 750 parts of water with 85 parts of solid silver nitrate, the mixture being warmed to 50° C. and stirred until dissolved, following which the two solutions were combined in conventional fashion, precipitated by addition of sufficient 1.0 N sulfuric acid to lower the solution pH to 3.0, and then cooled to 20° C. The precipitate was slurried with water and allowed to settle, whereupon the supernatent liquid was removed. To the precipitate were then added 200 parts of water, 40 parts of PLEX 3293 gelatin, and 5 parts of sodium chloride, the gelatin being allowed to soak for 30 minutes and then warmed to 40° C. to effectuate dissolving. The solution was then adjusted to a pH of 7 with 1.0 N sodium hydroxide and sufficient water was added to make 1000 ml of total volume.

The photographic emulsion was then coated over the previous gelatin coating in a conventional dip coater at a coating speed of 1.5 centimeters per second and allowed to air dry. The resultant emulsion provided a silver concentration of 60 mg per square decimeter.

Developing solutions were then prepared by mixing the following components:

Hydroquinone: 40 parts
Ascorbic acid: 5 parts
Elon: 4 parts
Sodium bromide: 2 parts
Sodium sulfate: 50 parts
Benzotriozole: 0.1 part
Water sufficient to make a volume of: 1 liter A second solution was prepared by mixing Sodium carbonate: 100 parts
Sodium bromide: 4 parts
Sodium sulfate: 200 parts
Water to provide a volume of: 2 liters A sample of the construction was then exposed through a target to a tungsten light source of about 1.3 meter candles for 5 seconds. The sample was then dipped in the first developing solution for a period of 10 seconds, followed by 20 seconds in the second solution shown above. The sample was then washed in hot tap water, about 50° C., for a few seconds, until the soluble gelatin was removed.

The resultant structure was a clear gelatin relief image, wherein the areas covered by the gelatin image correspond with the transparent areas in the target utilized to image the structure.

The gelatin relief image provided above may be dyed to a suitable color by dipping in a dye solution prepared by mixing the following components:

Methylene blue: 1 gram
Water: 100 ml

Sodium hydroxide (10 percent by weight aqueous solution): 5 ml

The sample was left in the solution for 15 seconds, followed by rinsing with tap water and drying, resulting in a blue gelatin image suitable for use as, for example, an overhead transparency.

As an alternative to drying the gelatin relief image itself, a suitable dye may be included in the gelatin coating at the time of application, the other steps of the above process remaining the same, resulting in a dyed gelatin relief image after the washing thereof with hot water. Alternatively, a pigment may be added to the gelatin layer, e.g., zinc oxide powder, which will provide in essence a suspension of the pigment in the gelatin coating. After the washing of the structure with hot water, a pigmented gelatin relief image will result.

EXAMPLE 2

A coating solution was prepared by mixing the following components:

Kind and Knox 1312 Pigskin Gelatin (tradename for a gelatin material commercially available from Kind and Knox, prepared as a 10 percent by weight aqueous solution): 40 parts Monastral Blue TB 297D, a blue dye as a 10 percent by weight solution in water: 10 parts Water: 50 parts The above solution was then coated at 32 cubic centimeters per square meter on a 100 micrometer primed and subbed polyester sheet and dried at 40° C.

A chlorobromide photographic emulsion was then prepared as per Example 1 in the presence of a commercially available phthalated gelatin, the gelatin being Rousselot 18832, commercially available from Rousselot, the emulsion containing about 30 grams of the gelatin per mole of silver halide, and additional gelatin of the same type was then added thereto to make the total 50 grams of gelatin per mole of silver halide.

A photographic coating application was prepared by mixing the following components:

The photographic emulsion from above (contains 13.6 percent silver by weight): 39.6 grams Rousselot 18832 phthalated gelatin, as a 10 percent by weight aqueous solution: 35.0 grams Triton X 200, tradename for sodium alkylaryl polyether sulfonate, commercially available from Rohm & Haas: 0.3 ml Glycerine: 1.5 grams Water: 15.4 grams This solution was then coated at 40 cubic centimeters per square meter over the gelatin layer, followed by drying at 40° C. A sample of the material was then exposed for 8 seconds to a 10 meter candle tungsten light source in contact with a half tone test pattern and a sensitivity guide step tablet. The sample was then processed in a two bath roller processor at a speed of 3 centimeters per second, thereby providing a residence time of 3 seconds in the first bath and 4 seconds in the second bath. The two baths were prepared as follows:

First Process Bath:

Ascorbic acid: 5 parts

Elon: 4 parts

Hydroquinone: 40 parts

Sodium bromide: 2 parts

Benzotriozole, as a 10% by weight solution in ethanol: 1 ml

Sodium sulfate: 50 parts

Water to: 1 liter

Second Process Bath:

Sodium carbonate: 50 parts

Sodium sulfate: 30 parts

Sodium bromide: 2 parts

Sodium hydroxide: 2 parts

Monoethanol amine: 30 parts

Water to: 1 liter

After treatment in the two baths the sample was sprayed with 50° C. water for about 10 seconds, following which the image was lightly scrubbed to remove residual gelatin in the background areas, following which the sample was air dried. The resultant image revealed four steps on the sensitivity guide and the 150 line per inch half-tone image illustrated dots over the entire range of the test target.

EXAMPLE 3

This example illustrates the use of a different substituted gelatin in the photographic emulsion.

To prepare the gelatin underlayer, the following mixture was prepared:

Monastral blue pigment, 10 percent by weight aqueous solution: 3 parts

PL 1443 gelatin (commercially available from P. Leiner and Sons), as a 10 percent by weight solution in water: 20 parts Triton X 200, as a 23 percent by weight solution in water: 0.5 parts Water: 27 parts The mixture was coated at 19 cubic centimeters per square meter on 100 micrometer primed and subbed polyester and dried at 40° C. The same photographic emulsion as Example 2 was prepared, whereupon the following photographic coating solution was mixed together:

Emulsion from Example 2: 80 grams

PL 4974 gelatin (tradename for a 100 percent succinated gelatin commercially available from P. Leiner and Sons), as a 10 percent by weight aqueous solution: 70 grams Triton X 200: 1 ml Glycerine: 1.5 ml BRIJ 58 (tradename for polyoxyethylene cetyl ether, commercially available from Atlas Chemical), as a 1 percent aqueous solution: 1 ml This provided a silver halide emulsion having a gelatin therein containing 58 percent by weight succinated substitution and 42 percent by weight phthalated substitution.

The mixture was coated at 39 cubic centimeters per square meter over the gelatin underlayer and dried at 40° C. After exposure for 15 seconds to the light source of Example 2 and process in the same fashion as Example 2, the silver halide emulsion washed off completely leaving a blue relief image in the gelatin underlayer.

EXAMPLE 4

In accordance with the teachings of U.S. Pat. No. 2,614,928, 89 parts of PL 1364, tradename for an ossein gelatin, commercially available from P. Leiner and Sons was mixed for 30 minutes in 611 parts of cold water. To this solution were added 770 parts of a large grain iodobromide photographic emulsion which had been conventionally prepared using 31 parts of the same gelatin. The temperature was then raised to 40° C. and sufficient 1 N sodium hydroxide was added to raise the pH to 10.0. While maintaining this pH with the sodium hydroxide, a solution containing 6 parts of phthalic anhydride in 42 ml of acetone was added. The mixture was stirred for 5 minutes, following which the pH was reduced to 6.5 with 1 N sulfuric acid. When the above emulsion was applied and processed as per Example 3, the emulsion layer again washed off entirely, leaving a gelatin relief image in the gelatin underlayer.

EXAMPLE 5

Example 4 was repeated with the exception that 6 parts of succinic anhydride in 50 ml of acetone was utilized instead of the phthalic anhydride. The construction was exposed and processed as per Example 3, with the same results being obtained.

EXAMPLE 6

A cyanoethylated gelatin was prepared in accordance with the teachings of U.S. Pat. No. 2,518,666. Following preparation of the gelatin, 125 grams of same were dissolved in 450 parts of water at 50° C., to which 400 grams of potassium bromide and 5 grams of potassium iodide were then added. A solution of silver nitrate containing 500 grams in 450 grams of water was added to the first solution over a 10 minute period. The entire mixture was then stirred for 10 minutes while maintaining the temperature at 50° C. To this solution, 550 ml of saturated aqueous sodium sulfate was added to flock the gelatin/silver halide emulsion. The entire mixture was then chilled in an ice bath and allowed to settle for 3 minutes. The supernatent liquid was decanted and the remaining precipitate washed by stirring with water and allowing to settle. This washing procedure was repeated 3 times. At this point 225 grams of additional gelatin of the same type were added with sufficient water to bring the total weight of the mixture to 4,600 grams. The mixture was then heated to 50° C. and stirred to achieve uniformity.

This emulsion was then substituted for the emulsion of Example 2 and coated over the gelatin layer of Example 2, whereupon the sample was exposed for 5 seconds to room light through a step tablet.

After processing as per Example 2, a clear image was visible in the gelatin layer, the entire silver halide layer being removed during the processing steps.

EXAMPLE 7

A gelatin layer was prepared by first mixing the following components:

- PL 1364, tradename for a gelatin commercially available from P. Leiner and Sons: 4 grams
- Sodium formaldehyde bisulfite: 0.3 gram
- Triton X 200: 0.8 ml
- Hydroquinone: 2 grams
- RT 698B Watchung/Red pigment as a 10 percent aqueous dispersion: 5 ml
- Water: 44 grams This mixture, which incorporates the hydroquinone developer therein, was coated at 40 cubic centimeters per square meter on 75 micrometer primed polyester and dried at 40° C., whereupon the photographic emulsion layer of Example 1 was coated thereover, using the same conditions as described in Example 2.

The resultant material was exposed to light as per Example 1 and processed in a single bath roller processor with a resident time of about 4 seconds in the bath. The bath composition was as follows:

- Sodium bromide: 2 grams
- Sodium carbonate: 50 grams
- Sodium sulfate: 50 grams Monoethanol amine: 20 ml
- Water to: 1 liter Following processing the sample was sprayed with 50° C. water for about 10 seconds, whereupon a resultant red gelatin relief image became clearly visible.

EXAMPLE 8

This example demonstrates the use of a colloid other than gelatin in the relief-forming underlayer.

To prepare the colloid underlayer, the following mixture was prepared:

- Eastman Kodak T2145 Casein, available commercially from Eastman Kodak: 5.5 grams
- 1 N sodium hydroxide: 5.5 ml
- Water to provide a weight of: 53 grams The above mixture was then mixed as follows:

- Above casein solution: 10 parts
- Monastral blue pigment, 10 percent by weight aqueous dispersion: 2.5 parts
- Water: 37.5 parts This latter mixture was then coated on 75 micrometer polyester to provide a dry coating weight of 0.8 gram per square meter.

The above was then overcoated, dried, exposed and processed as in Example 2. The silver halide emulsion washed off entirely and a clearly defined blue relief image was obtained in the pigmented casein underlayer.

EXAMPLE 9

This example makes use of a direct positive silver halide emulsion. To prepare the gelatin underlayer, the following mixture was prepared:

- Benzidene Yellow pigment, 10 percent by weight aqueous dispersion: 1.25 parts
- PL 1443 gelatin (commercially available from P. Leiner & Sons) as a 10 percent by weight solution in water: 5 parts
- Triton X-200, as a 23 percent by weight solution in water: 0.25 parts
- Water: 18.5 parts The mixture was coated on 75 micrometer corona treated polyester to provide a dry coating weight of 1.0 gram per square meter using a conventional dip coater.

A silver halide emulsion was prepared with PL 4261, a 100 percent phthalated gelatin from P. Leiner & Sons, which contained silver chloride and silver bromide in the approximate mole percent ratio of 66 to 33 respectively, per gram mole of silver halide in the emulsion. To this emulsion were added 15 ml of a $10^{-3}$ molar solution of sodium chloroaurate and 2.0 ml of a $10^{-3}$ molar solution of stannous chloride. The resulting emulsion was heated to 45° C. for 45 minutes followed by cooling to 35° C. At this point, 150 ml of methanol containing 1.0 gram of Pinacryptol Yellow (a sensitizing dye) dissolved therein, 50 ml of water, and 20 ml of a 2.5 molar aqueous potassium chloride solution were added to the emulsion. This emulsion was then a direct positive type.

A photographic coating solution was then prepared by mixing:

- The above direct positive emulsion: 21.2 parts
- PL 4261 100 percent phthalated gelatin (commercially available from P. Leiner & Sons), as a 10 percent by weight solution in water: 15 parts
- Triton X-200, as a 23 percent by weight aqueous solution: 0.7 parts
- Water: 3.8 parts The mixture was coated over the gelatin underlayer to provide a silver coating weight of 50 mg per square decimeter. After exposing for 5 seconds to a 100 foot candle tungsten source, using the same original as in Example 2, and processing as in Example 2, the silver halide emulsion washed off completely having a yellow relief image in the gelatin underlayer. This image is a positive copy of the original (i.e., the pigmented areas of the sample correspond with the opaque areas of the original).

EXAMPLE 10

To the 4 percent by weight gelatin solution of Example 1 was added 0.7 gram of hydroquinone, 10 grams of a 2 percent by weight aqueous solution of carboxymethyl cellulose, to increase solution viscosity, and 0.5 gram of congo red dye. This solution was coated and processed as per Example 7. The result after the hot water wash was a dye gelatin relief image.

What is claimed is:

1. An article comprising a substrate having coated on one surface thereof a first layer comprising a colloidal material capable of being tanned when contacted with oxidized silver halide developers, and overlying said first layer a second layer comprising a photographic silver halide emulsion, said emulsion containing substituted gelatin therein, said substituted gelatin being substantially resistant to tanning when contacted by said oxidized silver halide developers.

2. The article of claim 1 wherein said first layer contains a pigment dispersed therein.

3. The article of claim 1 wherein said photographic silver halide emulsion is negative-acting.

4. The article of claim 1 wherein said photographic silver halide emulsion is positive-acting.

5. The article of claim 1 wherein said colloidal material comprises unsubstituted gelatin.

6. The article of claim 1 wherein said colloidal material comprises casein.

7. The article of claim 1 wherein said first layer further contains a silver halide developer therein.

* * * * *